US011441789B2

(12) United States Patent
Lin et al.

(10) Patent No.: US 11,441,789 B2
(45) Date of Patent: Sep. 13, 2022

(54) CONVECTION/RADIATION AIR CONDITIONING TERMINAL AND AIR CONDITIONING SYSTEM

(71) Applicant: TSINGHUA UNIVERSITY, Beijing (CN)

(72) Inventors: Borong Lin, Beijing (CN); Hongli Sun, Beijing (CN); Hui Li, Beijing (CN); Zhirong Lin, Beijing (CN); Mengfan Duan, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 370 days.

(21) Appl. No.: 16/862,881

(22) Filed: Apr. 30, 2020

(65) Prior Publication Data

US 2020/0355375 A1 Nov. 12, 2020

(30) Foreign Application Priority Data

May 8, 2019 (CN) ..... 201910379008.6

(51) Int. Cl.

*F24F 1/0007* (2019.01)
*F28F 13/18* (2006.01)
*F24F 5/00* (2006.01)

(52) U.S. Cl.

CPC ..... *F24F 1/00077* (2019.02); *F24F 1/00073* (2019.02); *F28F 13/185* (2013.01); *F24F 5/0089* (2013.01); *F28F 2260/02* (2013.01)

(58) Field of Classification Search

CPC .. F24F 1/00077; F24F 1/00073; F24F 5/0089; F28F 13/185; F28F 2260/02; F28D 2015/0225

See application file for complete search history.

(56) References Cited

U.S. PATENT DOCUMENTS 6,216,343 B1 * 4/2001 Leland ..... F28D 15/04 29/890.032
9,612,060 B2 * 4/2017 Sauciuc ..... F28D 15/0275
2016/0131435 A1 * 5/2016 Lee ..... F28D 15/0233 165/104.21

* cited by examiner

*Primary Examiner* — Joseph F Trpisovsky
(74) *Attorney, Agent, or Firm* — Hoffmann & Baron, LLP

(57) ABSTRACT

A convection/radiation air conditioning terminal and an air conditioning system are provided. The convection/radiation air conditioning terminal includes a heat pipe. One end of the heat pipe is connected to a first heat exchange pipeline, and the other end of the heat pipe is connected to a second heat exchange pipeline. The heat pipe includes multiple first microchannels which are arranged and independent of each other, and multiple second microchannels which are arranged and independent of each other, where the first microchannels and the second microchannels are arranged and independent of each other. The first microchannels are each internally provided with a first heat exchange working medium, and the second microchannels are each internally provided with a second heat exchange working medium.

20 Claims, 3 Drawing Sheets

CONVECTION/RADIATION AIR CONDITIONING TERMINAL AND AIR CONDITIONING SYSTEM

CROSS-REFERENCE TO RELATED APPLICATIONS

This application claims priority to Chinese Patent Application No. 201910379008.6, filed on May 8, 2019, the disclosure of which is incorporated by reference herein in its entirety for all purposes.

TECHNICAL FIELD

The present invention relates to the technical field of air conditioning, and in particular, to a convection/radiation air conditioning terminal and an air conditioning system.

BACKGROUND

Central heating is not commonly used in the hot summer and cold winter regions in China. There are various heating terminals in winter which mainly fall into convection terminals and radiation terminals. The convection terminals (such as fan coil units and household air conditioners) achieve heating by delivering hot air indoors, which provides high intermittence but poor thermal comfort. In the existing radiant heating terminal, hot water is mainly produced by a compressor/wall-mounted gas boiler to heat the radiation terminal (such as a floor heating system and a radiator). The radiant heating system has high thermal comfort; however, due to large thermal inertia and small heat transfer coefficient between the terminal and a room, it takes a long time from start-up to a stable heating state and the intermittent performance is poor. Therefore, most of the radiant heating terminals run continuously. Compared with the household air conditioner with intermittent heating, the radiant heating terminal consumes more energy. According to the climate characteristics of hot summer and cold winter regions in China, intermittent heating should be taken in winter heating. The key to improving the applicability of the radiation terminals lies in the improvement of the intermittence of existing radiant heating terminals.

Currently, there is a technology that uses a heat pipe/flat heat pipe for radiant heating. Although this method can achieve rapid heating of the terminal, it does not effectively solve the problem of difficulty in "terminal-indoor" heat exchange. Indoor heating has a slow response speed, and its intermittence is similar to that of the existing radiant heating terminal (such as a radiator). In addition, the flat heat pipe/heat pipe in the prior art is only filled with a single working medium. This leads to the problem that while the heating demand in winter can be met, the cooling demand in summer cannot be met, and further leads to the waste of floor space at the radiation terminal and the problem that the radiation terminal cannot be used in both winter and summer. In addition, cold and heat sources of the existing radiation terminals all come from a water system, and thus there is a heat exchange link from the heat source to the water system, which causes a certain heat loss.

In view of this, there is an urgent need for a convection/radiation air conditioning terminal and an air conditioning system that can solve the foregoing problems.

The information disclosed herein is only intended to deepen the understanding of the general background of the present invention, and should not be regarded as an acknowledgement or any form of suggestion that this information constitutes the prior art conventional to those skilled in the art.

SUMMARY

A first objective of the present invention is to provide a convection/radiation air conditioning terminal to solve the technical problems that during heating or cooling in the prior art, a radiation terminal has slow response speed and poor intermittence and cannot be used in both winter and summer.

To achieve the above objective, the present invention adopts the following technical solutions:

a convection/radiation air conditioning terminal provided by the present invention, including a heat pipe;

where one end of the heat pipe is connected to a first heat exchange pipeline, and the other end of the heat pipe is connected to a second heat exchange pipeline; the heat pipe includes a plurality of first microchannels which are arranged and independent of each other and a plurality of second microchannels which are arranged and independent of each other, where the first microchannels and the second microchannels are arranged and independent of each other; the first microchannels are each internally provided with a first heat exchange working medium, and the second microchannels are each internally provided with a second heat exchange working medium.

In any foregoing technical solution, further, both ends of the first microchannel are respectively in contact with the first heat exchange pipeline and the second heat exchange pipeline for heat transfer; and both ends of the second microchannel are respectively in contact with the first heat exchange pipeline and the second heat exchange pipeline for heat transfer.

In any foregoing technical solution, further, the first heat exchange pipeline is provided with a first installation port, and the second heat exchange pipeline is provided with a second installation port;

one end of the first microchannel extends into the first heat exchange pipeline from the first installation port, and the other end extends into the second heat exchange pipeline from the second installation port;

one end of the second microchannel extends into the first heat exchange pipeline from the first installation port, and the other end extends into the second heat exchange pipeline from the second installation port.

In any foregoing technical solution, further, the first microchannels and the second microchannels are alternately arranged.

In any foregoing technical solution, further, the convection/radiation air conditioning terminal further includes a heat pipe shell which coats the heat pipe;

the heat pipe shell is fixedly connected to the first heat exchange pipeline at the first installation port, and the heat pipe shell is fixedly connected to the second heat exchange pipeline at the second installation port.

In any foregoing technical solution, further, the first heat exchange pipeline is connected to an evaporator, and the second heat exchange pipeline is connected to a condenser.

In any foregoing technical solution, further, the first heat exchange working medium is a heating working medium and the second heat exchange working medium is a cooling working medium.

A second objective of the present invention is to provide an air conditioning system to solve the technical problems that during heating or cooling in the prior art, a radiation terminal has slow response speed and poor intermittence and wastes occupied space since the radiation terminal cannot be used in both winter and summer.

The present invention further provides an air conditioning system, including the foregoing convection/radiation air conditioning terminal, a compressor, an outdoor unit, a condenser and an evaporator, where the outdoor unit, the condenser and the evaporator are all in communication with each other and arranged on the compressor;

the evaporator transfers heat with a first microchannel through a first heat exchange pipeline, and the condenser transfers heat with a second microchannel through a second heat exchange pipeline.

In any foregoing technical solution, further, the air conditioning system includes a three-way valve;

where the evaporator, the condenser and the compressor are communicated with three ports of the three-way valve respectively.

In any foregoing technical solution, further, the air conditioning system includes fans;

where both ends of a heat pipe are each provided with at least one fan.

In any foregoing technical solution, further, a side of a heat pipe shell towards a wall is provided with a fin structure, and an air flow channel is formed between the fin structure and the wall.

In any foregoing technical solution, further, the fin structure is a corrugated fin.

In any foregoing technical solution, further, the compressor and/or the outdoor unit is embedded in the wall.

The present invention has the following beneficial effects:

a convection/radiation air conditioning terminal provided by the present invention includes a heat pipe, one end of the heat pipe is connected to a first heat exchange pipeline, and the other end of the heat pipe is connected to a second heat exchange pipeline; the heat pipe includes a plurality of first microchannels which are arranged and independent of each other and a plurality of second microchannels which are arranged and independent of each other, where the first microchannels and the second microchannels are arranged and independent of each other; the first microchannels are each internally provided with a first heat exchange working medium, and the second microchannels are each internally provided with a second heat exchange working medium. That is, when cooling is performed in summer, the convection/radiation air conditioning terminal has independent channels used for the cooling working medium, and when heating is performed in winter, the convection/radiation air conditioning terminal has independent channels used for the heating working medium. Therefore, cooling and heating are performed by the independent channels respectively, thus realizing the function of using the convection/radiation air conditioning terminal in both winter and summer. In addition, the convection/radiation air conditioning terminal generates a high-temperature and high-pressure refrigerant or a low-temperature and low-pressure refrigerant through the compressor, and can be in direct contact with the heat pipe through the first heat exchange pipeline or the second heat exchange pipeline respectively to perform heat transfer without heat exchange through the water system again, thereby improving the speed of heat exchange with the heat pipe and reducing energy consumption.

An air conditioning system provided by the present invention includes the foregoing convection/radiation air conditioning terminal, a compressor, an outdoor unit, a condenser and an evaporator, where the outdoor unit, the condenser and the evaporator are all in communication with each other and arranged on the compressor, the evaporator transfers heat with the heat pipe through a first heat exchange pipeline, and the condenser transfers heat with the heat pipe through a second heat exchange pipeline.

It should be noted that the structure of the convection/radiation air conditioning terminal and the resulting beneficial effects have been described in detail above, so they will not be repeated herein.

BRIEF DESCRIPTION OF THE DRAWINGS

To describe the technical solutions in the specific implementations of the present invention or the prior art more clearly, the following briefly introduces accompanying drawings required for describing the specific implementations or the prior art. Apparently, the accompanying drawings in the following description show merely some implementations of the present invention, and a person of ordinary skill in the art may still derive other accompanying drawings from these accompanying drawings without creative efforts.

Figure 1:
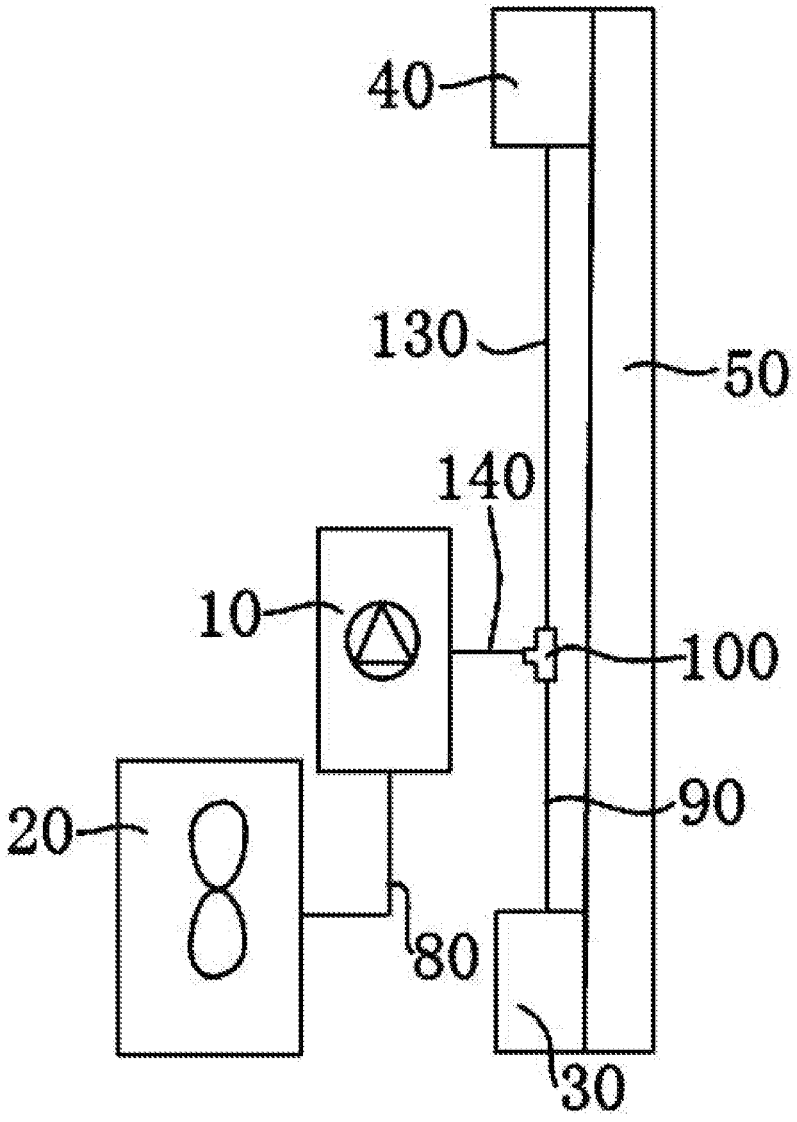
FIG. 1 is a schematic diagram of an air conditioning system provided by an example.

Reference numerals: 10. compressor, 20. outdoor unit, 30. condenser, 40. evaporator, 50. heat pipe, 60. fin structure, 70. fan, 80. first pipeline, 90. second pipeline, 100. three-way valve, 110. air flow channel, 120. wall, 130. third pipeline, 140. fourth pipeline, 501. first microchannel, 502. second microchannel.

DETAILED DESCRIPTION

The following clearly and completely describes the technical solutions of the present invention with reference to accompanying drawings. Apparently, the described examples are merely some rather than all of the examples of the present invention. All other examples obtained by a person of ordinary skill in the art based on the examples of the present invention without creative efforts shall fall within the protection scope of the present invention.

In the description of the present invention, it should be noted that the terms "first" and "second" in the description of the present invention are only used for description purpose and cannot be understood to indicate or imply relative importance.

In the description of the present invention, it should be noted that, unless otherwise clearly specified and limited, meanings of terms "install", "connected with", and "connected to" should be understood in a board sense. For example, the connection may be a fixed connection, a removable connection, or an integral connection; may be a mechanical connection or an electrical connection; may be a direct connection or an indirect connection by using an intermediate medium; or may be intercommunication between two components. A person of ordinary skill in the art may understand specific meanings of the foregoing terms in the present invention based on a specific situation.

Figure 2:
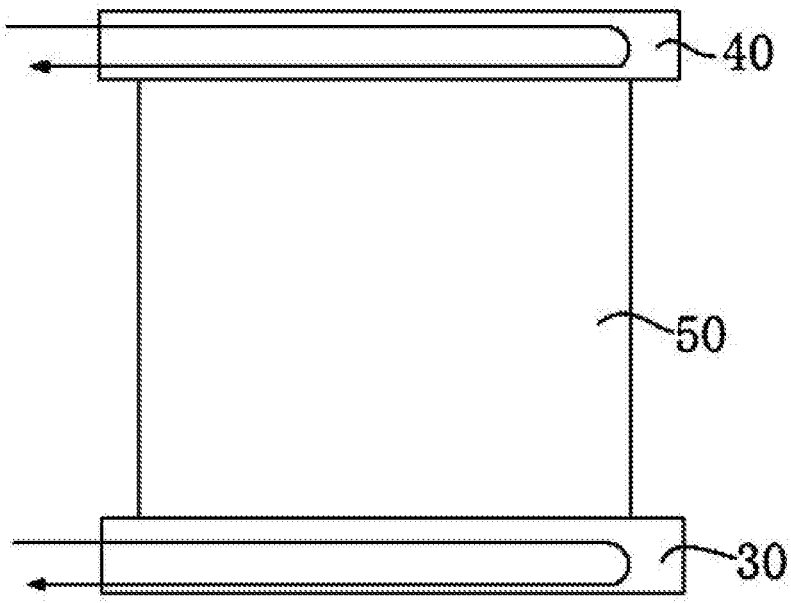
FIG. 2 is a first schematic diagram of a convection/radiation air conditioning terminal provided by an example.
Figure 3:
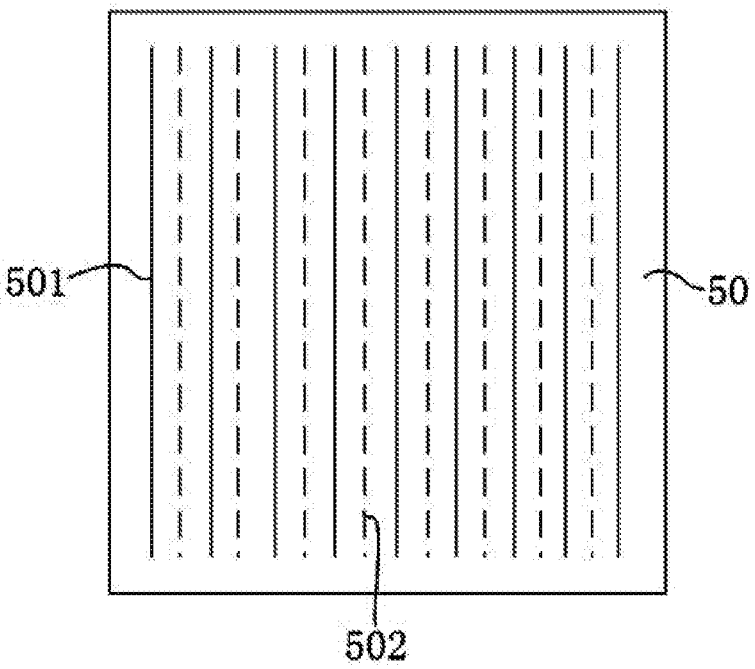
FIG. 3 is a second schematic diagram of a convection/radiation air conditioning terminal provided by an example.

As shown in FIG. 1 to FIG. 3, a convection/radiation air conditioning terminal provided by this example includes a heat pipe 50, where one end of the heat pipe 50 is connected to a first heat exchange pipeline, and the other end of the heat pipe 50 is connected to a second heat exchange pipeline; the heat pipe 50 includes a plurality of first microchannels 501 which are arranged and independent of each other and a plurality of second microchannels 502 which are arranged and independent of each other, where the first microchannels 501 and the second microchannels 502 are arranged and independent of each other; the first microchannels 501 are each internally provided with a first heat exchange working medium, and the second microchannels 502 are each internally provided with a second heat exchange working medium.

When the convection/radiation air conditioning terminal is used, the first heat exchange pipeline may be connected to an evaporator 40, and the second heat exchange pipeline may be connected to a condenser 30; meanwhile, the first heat exchange working medium is a heating working medium, and the second heat exchange working medium is a cooling working medium.

Continue to refer to FIG. 1. In actual use, for example, in winter, a compressor 10 operates and makes a high-temperature and high-pressure refrigerant flow out, and the refrigerant flows into the condenser 30 through a pipeline; the high-temperature and high-pressure refrigerant is cooled and releases heat in the condenser 30, and the released heat can contact and be exchanged with the heat pipe 50, so that the heating working medium in the first microchannels 501 of the heat pipe 50 is heated and boiled, then all the first microchannels 501 in the heat pipe 50 are heated by using a heat pipe principle, and the whole heat pipe 50 is further heated by heat conduction; that is, the convection/radiation air conditioning terminal is heated, thereby achieving heating. In summer, the compressor 10 operates and makes a low-temperature and low-pressure refrigerant flow out, and the refrigerant flows to the evaporator 40 along the pipeline; the low-temperature and low-pressure refrigerant is heated and absorbs heat in the evaporator 40, so that the cooling working medium in the second microchannels 502 in the heat pipe 50 connected to the evaporator 40 releases heat and condenses, then the second microchannels 502 are cooled by using the heat pipe principle, and the whole heat pipe 50 is further cooled by heat conduction; that is, the convection/radiation air conditioning terminal is cooled to realize cooling.

In summary, in the convection/radiation air conditioning terminal structure, the microchannels in the heat pipe 50 are divided into the first microchannels 501 for circulating the heating working medium and the second microchannels 502 for circulating the cooling working medium, and the first microchannels 501 and the second microchannel 502 are not communicated with each other. Therefore, when cooling is performed in summer, the convection/radiation air conditioning terminal has independent channels used for the cooling working medium, and when heating is performed in winter, the convection/radiation air conditioning terminal has independent channels used for the heating working medium. As a result, cooling and heating are performed by the independent channels respectively, thus realizing the function of using the convection/radiation air conditioning terminal in both winter and summer.

In addition, the convection/radiation air conditioning terminal generates the high-temperature and high-pressure refrigerant or the low-temperature and low-pressure refrigerant through the compressor 10, and the refrigerants can flow to the condenser 30 and the evaporator 40 respectively. The condenser 30 is connected to the second heat exchange pipeline, and the evaporator 40 is connected to the first heat exchange pipeline. Since the first heat exchange pipeline is connected to one end of the heat pipe 50 and the second heat exchange pipeline is connected to the other end of the heat pipe 50, the heat pipe 50 can directly contact with the refrigerant flowing to the condenser 30 and can also directly contact with the refrigerant flowing to the evaporator 40 at the same time. Therefore, heat exchange does not need to be performed through the water system again when performed, thereby improving the speed of heat exchange with the heat pipe 50 and reducing energy consumption.

Preferably, the first microchannels and the second microchannels are capillaries.

In actual use, the plurality of first microchannels 501 are arranged in parallel with each other, the plurality of second microchannels 502 are also arranged in parallel with each other, and the first microchannels 501 and the second microchannels 502 are arranged in parallel with each other.

It should be added that the arrangement is not limited to such an arrangement mode that "the first heat exchange pipeline is connected to the evaporator 40 and the second heat exchange pipeline is connected to the condenser 30". It may also be that the first heat exchange pipeline is connected to the condenser 30 while the second heat exchange pipeline is connected to the evaporator 40, as long as the condenser 30 and the evaporator 40 transfer heat with the heat pipe 50 respectively.

It should be added that the categories of the first heat exchange working medium and the second heat exchange working medium are not limited to such a mode that "the first heat exchange working medium is a heating working medium and the second heat exchange working medium is a cooling working medium". It may also be that the first heat exchange working medium is a cooling working medium while the second heat exchange working medium is a heating working medium, as long as the heat pipe 50 can transfer heat with the contacted refrigerant.

In an optional solution of this example, as shown in FIGS. 2 and 3, both ends of each first microchannel 501 are respectively in contact with the first heat exchange pipeline and the second heat exchange pipeline for heat transfer, and both ends of each second microchannel 502 are respectively in contact with the first heat exchange pipeline and the second heat exchange pipeline for heat transfer. That is, the first microchannel 501 can directly transfer heat with the refrigerants flowing through the condenser 30 and the evaporator 40, and the second microchannel 502 can also directly transfer heat with the refrigerants flowing through the condenser 30 and the evaporator 40 without intermediate heat exchange through the water system again, thereby improving the speed of heat exchange between the refrigerants and the heat pipe 50 and reducing energy consumption.

Specifically, in this example, the first heat exchange pipeline may be provided with a first installation port and the second heat exchange pipeline may be provided with a second installation port; one end of the first microchannel 501 extends into the first heat exchange pipeline from the first installation port and the other end extends into the second heat exchange pipeline from the second installation port. Similarly, one end of the second microchannel 502 extends into the first heat exchange pipeline from the first installation port and the other end extends into the second heat exchange pipeline from the second installation port.

Such an arrangement ensures that both ends of the heat pipe 50 can extend into the first heat exchange pipeline and the second heat exchange pipeline respectively and directly contact with the refrigerants flowing through the first heat exchange pipeline and the second heat exchange pipeline, so that the heat exchange speed and refrigeration and heating efficiency are higher, and the energy consumption is reduced.

Continue to refer to FIG. 3. Preferably, the first microchannels 501 and the second microchannels 502 are alternately arranged. That is, the second microchannels 502 are arranged between randomly adjacent first microchannels 501, or the first microchannels 501 are arranged between randomly adjacent second microchannels 502 to ensure a uniform and sufficient heat transfer area.

In some examples, the convection/radiation air conditioning terminal further includes a heat pipe shell which coats the heat pipe 50; a side of the heat pipe shell towards the first heat exchange pipeline is fixedly connected to the first installation port, and a side of the heat pipe shell towards the second heat exchange pipeline is fixedly connected to the second installation port.

Specifically, the heat pipe shell coats the heat pipe 50, which not only has certain protection to the heat pipe 50 and reduces the damage rate of the heat pipe 50, but also achieves the assembly of the whole heat pipe 50 with the first heat exchange pipeline and the second heat exchange pipeline by directly fixedly connecting the heat pipe shell to the first heat exchange pipeline and the second heat exchange pipeline. The plurality of first microchannels 501 and the plurality of second microchannels 502 do not need to be fixedly connected to the first heat exchange pipeline and the second heat exchange pipeline in sequence, thus improving the assembly convenience and saving the assembly time.

In addition, the convection/radiation air conditioning terminal also includes a radiation layer that coats the surface of the heat pipe shell. Such an arrangement improves the efficiency of radiant heat transfer.

The heat pipe shell can be welded and fixed to edges of both the first installation port and the second installation port, thereby ensuring the stability of joints of the heat pipe 50 and the first heat exchange pipeline and the second heat exchange pipeline.

In addition, reinforcing devices are arranged on the first heat exchange pipeline and the second heat exchange pipeline. Specifically, the reinforcing device sleeve an outer side wall of the first heat exchange pipeline/the second heat exchange pipeline and is fixedly connected to the heat pipe shell. Such an arrangement not only strengthens the structure of the first heat exchange pipeline and the second heat exchange pipeline, but also increases the firmness of the joint of the first heat exchange pipeline and the heat pipe shell and the firmness of the joint of the second heat exchange pipeline and the heat pipe shell, thus ensuring the working reliability of the convection/radiation air conditioning terminal in this example.

As shown in FIG. 1, this example further provides an air conditioning system, including a convection/radiation air conditioning terminal, a compressor 10, an outdoor unit 20, a condenser 30 and an evaporator 40, where the outdoor unit 20, the condenser 30 and the evaporator 40 are all in communication with each other and arranged on the compressor 10; the evaporator 40 transfers heat with a first microchannel 501 through a first heat exchange pipeline, and the condenser 30 transfers heat with a second microchannel 502 through a second heat exchange pipeline.

In actual use, when refrigeration is required in summer, the compressor 10 is started to work, so that the generated high-temperature and high-pressure refrigerant can flow to the outdoor unit 20 along a first pipeline 80 to dissipate heat. At this time, the compressor 10 is disconnected with the condenser 30, and only the compressor 10 and the evaporator 40 are communicated with each other, so that the generated low-temperature and low-pressure refrigerant can flow to the evaporator 40 along a third pipeline 130 to absorb heat and cool a heat pipe 50 to realize indoor refrigeration. When heating is required in winter, the compressor 10 is started to work, so that the low-temperature and low-pressure refrigerant flows to the outdoor unit 20 along the first pipeline 80 to absorb heat from the outside. At the same time, the compressor 10 is disconnected with the evaporator 40, and only the compressor 10 and the condenser 30 are communicated with each other, so that the generated high-temperature and high-pressure refrigerant flows to the condenser 30 along a second pipeline 90 to release heat to heat the heat pipe 50 to realize indoor heating.

It should be noted that the structure of the convection/radiation air conditioning terminal and the resulting beneficial effects have been described in detail above, so they will not be repeated herein.

Preferably, the air conditioning system further includes a three-way valve 100; and the evaporator 40, the condenser 30 and the compressor 10 are communicated with three ports of the three-way valve 100 respectively.

Specifically, the condenser 30 is communicated with a port of the three-way valve 100 through the second pipeline 90, the evaporator 40 is communicated with another port of the three-way valve 100 through the third pipeline 130, and the third port of the three-way valve 100 is communicated with the compressor 10 through a fourth pipeline 140. The three-way valve 100 can respectively control the opening and closing conditions of the two second pipelines 90 and the third pipeline 130, thereby controlling the conditions of communicating the evaporator 40 and the condenser 30 with the compressor 10 respectively, and facilitating the realization of refrigeration or heating.

Figure 4:
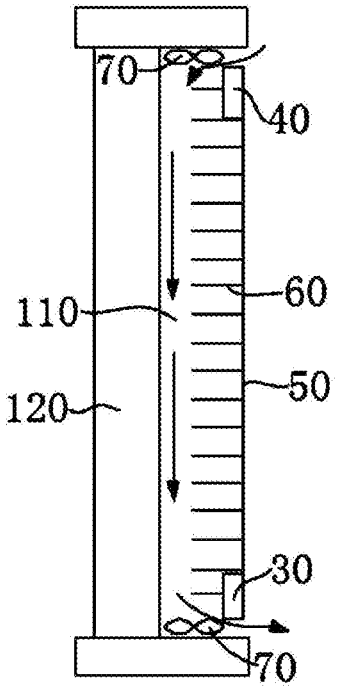
FIG. 4 is a schematic air flow diagram of an air conditioning system provided by an example when it is used in winter.
Figure 5:
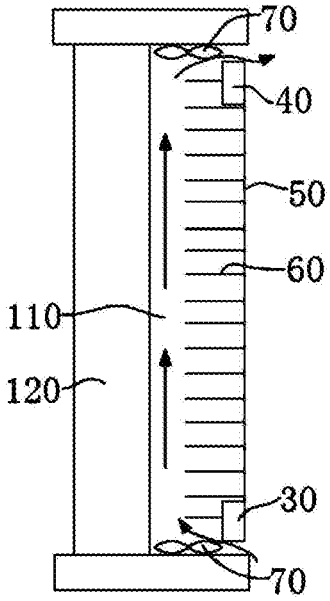
FIG. 5 is a schematic air flow diagram of the air conditioning system provided by the example when it is used in summer.

In an optional solution of this example, as shown in FIGS. 4 and 5, the air conditioning system further includes fans 70; both ends of the heat pipe 50 are each provided with at least one fan 70; that is, it is ensured that both ends of the heat pipe 50 are provided with the fans 70, and power generated by the fans 70 promotes air flow to improve heat transfer efficiency.

In this example, a side of a heat pipe shell towards a wall is provided with a fin structure 60, and an air flow channel 110 is formed between the fin structure 60 and the wall.

Continue to refer to FIG. 4, where arrows indicate the direction of air flow. During heating in winter, when the heat pipe 50 and the fin structure 60 are heated, the fan 70 is started to suck cold air from a top air opening, and the cold air flows through the air flow channel 110 and is heated into hot air through the fin structure 60, and then flows out of a bottom air opening into the room.

Continue to refer to FIG. 5, where arrows indicate the direction of air flow. When refrigeration is performed in summer, the heat pipe 50 and the fin structure 60 are cooled, and the fan 70 is started to suck indoor hot air from the bottom air opening, and the air flows through the air flow channel 110 and is cooled into cold air through the fin structure 60, and then flows out to the outside from the top air opening.

Preferably, the fin structure 60 is a corrugated fin, so that a velocity component of a fluid can be increased depending on the corrugated structure of the corrugated fin to enhance the heat transfer efficiency and obtain a better heat transfer effect.

In some example, the compressor 10 and/or the outdoor unit 20 is embedded in the wall 120 to realize the combination of the convection/radiation air conditioning terminal and an enclosure structure, reduce the inconvenience of later occupation of land or structural configuration, etc., and at the same time facilitate an assembly type residence to realize quick assembly and disassembly.

Specifically, both the compressor 10 and the outdoor unit 20 can be installed in the wall; that is, a first installation cavity and a second installation cavity need to be reserved in advance in the wall, the compressor 10 is placed in the first installation cavity, the outdoor unit 20 is placed in the second installation cavity, and at the same time, the enclosure is increased by further fixation through an installing bracket.

It should be noted that the installation of the compressor 10 and the outdoor unit 20 is not limited to the forgoing mode. The compressor 10 may also be installed in the wall or the outdoor unit 20 may be installed in the wall, as long as the occupied area can be reduced.

Finally, it should be noted that the above example are merely intended to describe the technical solutions of the present invention, rather than to limit the present invention. Although the present invention is described in detail with reference to the above examples, persons of ordinary skill in the art should understand that they may still make modifications to the technical solutions described in the above examples or make equivalent replacements to some or all technical features thereof. However, these modifications or replacements do not cause the essence of the corresponding technical solutions to depart from the scope of the technical solutions of the examples of the present invention.

What is claimed is:

1. A convection/radiation air conditioning terminal, comprising a heat pipe;

wherein one end of the heat pipe is connected to a first heat exchange pipeline, and the other end of the heat pipe is connected to a second heat exchange pipeline; the heat pipe comprises a plurality of first microchannels which are arranged and independent of each other and a plurality of second microchannels which are arranged and independent of each other, wherein the first microchannels and the second microchannels are arranged and independent of each other; the first microchannels are each internally provided with a first heat exchange working medium, and the second microchannels are each internally provided with a second heat exchange working medium.

2. The convection/radiation air conditioning terminal according to claim 1, wherein both ends of the first microchannel are respectively in contact with the first heat exchange pipeline and the second heat exchange pipeline for heat transfer; and both ends of the second microchannel are respectively in contact with the first heat exchange pipeline and the second heat exchange pipeline for heat transfer.

3. The convection/radiation air conditioning terminal according to claim 2, wherein the first heat exchange pipeline is provided with a first installation port, and the second heat exchange pipeline is provided with a second installation port;

one end of the first microchannel extends into the first heat exchange pipeline from the first installation port, and the other end extends into the second heat exchange pipeline from the second installation port; and one end of the second microchannel extends into the first heat exchange pipeline from the first installation port, and the other end extends into the second heat exchange pipeline from the second installation port.

4. The convection/radiation air conditioning terminal according to claim 3, further comprising a heat pipe shell which coats the heat pipe;

wherein the heat pipe shell is fixedly connected to the first heat exchange pipeline at the first installation port, and the heat pipe shell is fixedly connected to the second heat exchange pipeline at the second installation port.

5. The convection/radiation air conditioning terminal according to claim 1, wherein the first microchannels and the second microchannels are alternately arranged.

6. The convection/radiation air conditioning terminal according to claim 1, wherein the first heat exchange working medium is a heating working medium and the second heat exchange working medium is a cooling working medium.

7. An air conditioning system, comprising:

a convection/radiation air conditioning terminal including a heat pipe, wherein one end of the heat pipe is connected to a first heat exchange pipeline, and the other end of the heat pipe is connected to a second heat exchange pipeline, the heat pipe comprising a plurality of first microchannels which are arranged and independent of each other and a plurality of second microchannels which are arranged and independent of each other, wherein the first and second microchannels are arranged and independent of each other, the first microchannels are each internally provided with a first heat exchange working medium, and the second microchannels are each internally provided with a second heat exchange working medium;

a compressor;

an outdoor unit;

a condenser; and an evaporator;

wherein the outdoor unit, the condenser and the evaporator are all in communication with each other and arranged on the compressor, and wherein the evaporator transfers heat with a first microchannel through the first heat exchange pipeline, and the condenser transfers heat with a second microchannel through the second heat exchange pipeline.

8. The air conditioning system according to claim 7, wherein both ends of the first microchannel are respectively in contact with the first heat exchange pipeline and the second heat exchange pipeline for heat transfer, and both ends of the second microchannel are respectively in contact with the first heat exchange pipeline and the second heat exchange pipeline for heat transfer.

9. The air conditioning system according to claim 8, wherein the first heat exchange pipeline is provided with a first installation port, and the second heat exchange pipeline is provided with a second installation port;

wherein one end of the first microchannel extends into the first heat exchange pipeline from the first installation port, and the other end extends into the second heat exchange pipeline from the second installation port; and wherein one end of the second microchannel extends into the first heat exchange pipeline from the first installation port, and the other end extends into the second heat exchange pipeline from the second installation port.

10. The air conditioning system according to claim 9, wherein the convection/radiation air conditioning terminal further comprises a heat pipe shell which coats the heat pipe, and wherein the heat pipe shell is fixedly connected to the first heat exchange pipeline at the first installation port, and the heat pipe shell is fixedly connected to the second heat exchange pipeline at the second installation port.

11. The air conditioning system according to claim 7, wherein the first microchannels and the second microchannels are alternately arranged.

12. The air conditioning system according to claim 7, wherein the first heat exchange working medium is a heating working medium and the second heat exchange working medium is a cooling working medium.

13. The air conditioning system according to claim 7, further comprising a three-way valve;

wherein the evaporator, the condenser and the compressor are communicated with three ports of the three-way valve respectively.

14. The air conditioning system according to claim 8, further comprising a three-way valve;

wherein the evaporator, the condenser and the compressor are communicated with three ports of the three-way valve respectively.

15. The air conditioning system according to claim 9, further comprising a three-way valve;

wherein the evaporator, the condenser and the compressor are communicated with three ports of the three-way valve respectively.

16. The air conditioning system according to claim 10, further comprising a three-way valve;

wherein the evaporator, the condenser and the compressor are communicated with three ports of the three-way valve respectively.

17. The air conditioning system according to claim 11, further comprising a three-way valve;

wherein the evaporator, the condenser and the compressor are communicated with three ports of the three-way valve respectively.

18. The air conditioning system according to claim 12, further comprising a three-way valve;

wherein the evaporator, the condenser and the compressor are communicated with three ports of the three-way valve respectively.

19. The air conditioning system according to claim 7, further comprising a plurality of fans;

wherein both ends of a heat pipe are each provided with at least one fan.

20. The air conditioning system according to claim 19, wherein a side of a heat pipe shell towards a wall is provided with a fin structure, and an air flow channel is formed between the fin structure and the wall.

* * * * *